United States Patent [19]

Matsushita

[11] Patent Number: 5,005,049

[45] Date of Patent: Apr. 2, 1991

[54] COPYING MACHINE WITH CAPACITY TO MEASURE TRANSPARENCY OF ORIGINAL

[75] Inventor: Kouji Matsushita, Osaka, Japan

[73] Assignee: Minolta Camera Kabushiki Kaisha, Osaka, Japan

[21] Appl. No.: 395,438

[22] Filed: Aug. 17, 1989

[30] Foreign Application Priority Data

Aug. 18, 1988 [JP] Japan ..... 63-205205

[51] Int. Cl.[5] ..... G03G 15/00

[52] U.S. Cl. ..... 355/208; 355/228; 355/246; 355/311

[58] Field of Search ..... 355/208, 219, 221, 228, 355/229, 246, 311

[56] References Cited

U.S. PATENT DOCUMENTS 4,462,681 7/1984 Aerts et al. ..... 355/319
4,624,547 11/1986 Endo et al. .
4,640,603 2/1987 Honma .
4,702,589 10/1987 Ito .

FOREIGN PATENT DOCUMENTS 57-178255 11/1982 Japan .
58-153953 9/1983 Japan .
61-160769 7/1986 Japan .

*Primary Examiner*—R. L. Moses
*Attorney, Agent, or Firm*—Price, Gess & Ubell

[57] ABSTRACT

A copying machine of the present invention measures light transmittance of a document so as to adjust copying concentration on the basis of the measured result. The copying concentration is concretely adjusted by adjusting electrification voltage of a photosensitive body, and/or developing bias voltage, and/or quantity of exposure light. The copying machine is free from the occurrence of back image copying when a document is double-faced. A copying machine of the present invention further comprises means for discriminating whether the document is a double-faced one or a single-faced one.

19 Claims, 15 Drawing Sheets

COPYING MACHINE WITH CAPACITY TO MEASURE TRANSPARENCY OF ORIGINAL

BACKGROUND OF THE INVENTION

1. Field of the Invention

The present invention relates to a copying machine for copying images of a document with variable copying concentration.

2. Description of Related Art

When a double-faced document having images at both faces is copied, especially when the document is smaller in thickness, the images at the rear face are likely to be copied during the copying of those on the front face, that is the so-called back image copying may occur.

A method for preventing the above is disclosed in the Japanese Patent Application Laid-Open No. 61-160769 (1986), in which image concentration in the double-faced document copying is adjusted to be brighter than that in the single-faced document copying.

In the prior art, image concentration is also adjusted corresponding to document concentration which is concentration of background of the document. The document concentration is detected on the basis of light reflected from the document. However, some documents being equal in document concentration may be different in light transmittance. The larger the light transmittance, the more often the back image copying occurs. Therefore, even if the image concentration is adjusted corresponding to the document concentration, the back image copying may not be prevented.

Furthermore, in order to avoid the back image copying if the image concentration may be lowered too much, visibility of copy is inferior.

SUMMARY OF THE INVENTION

In order to solve the above problem, the present invention has been designed. A copying machine of the invention includes measuring means for measuring light transmittance of the document and adjusting the means for adjusting copying concentration corresponding to the measured result by measuring means. In order to adjust the copying concentration, the adjusting means concretely adjusts electrification voltage of a photosensitive body, and/or bias voltage to a developing unit, and/or quantity of light of a light source to illuminate the document. When the double-faced document is copied, the light transmittance of the document is measured so that the electrification voltage, and/or bias voltage, and/or the quantity of exposure light, are adjusted on the basis of the measured light transmittance.

The features of the invention will more fully be apparent from the following detailed description with accompanying drawings.

DESCRIPTION OF THE PREFERRED EMBODIMENTS

Figure 1:
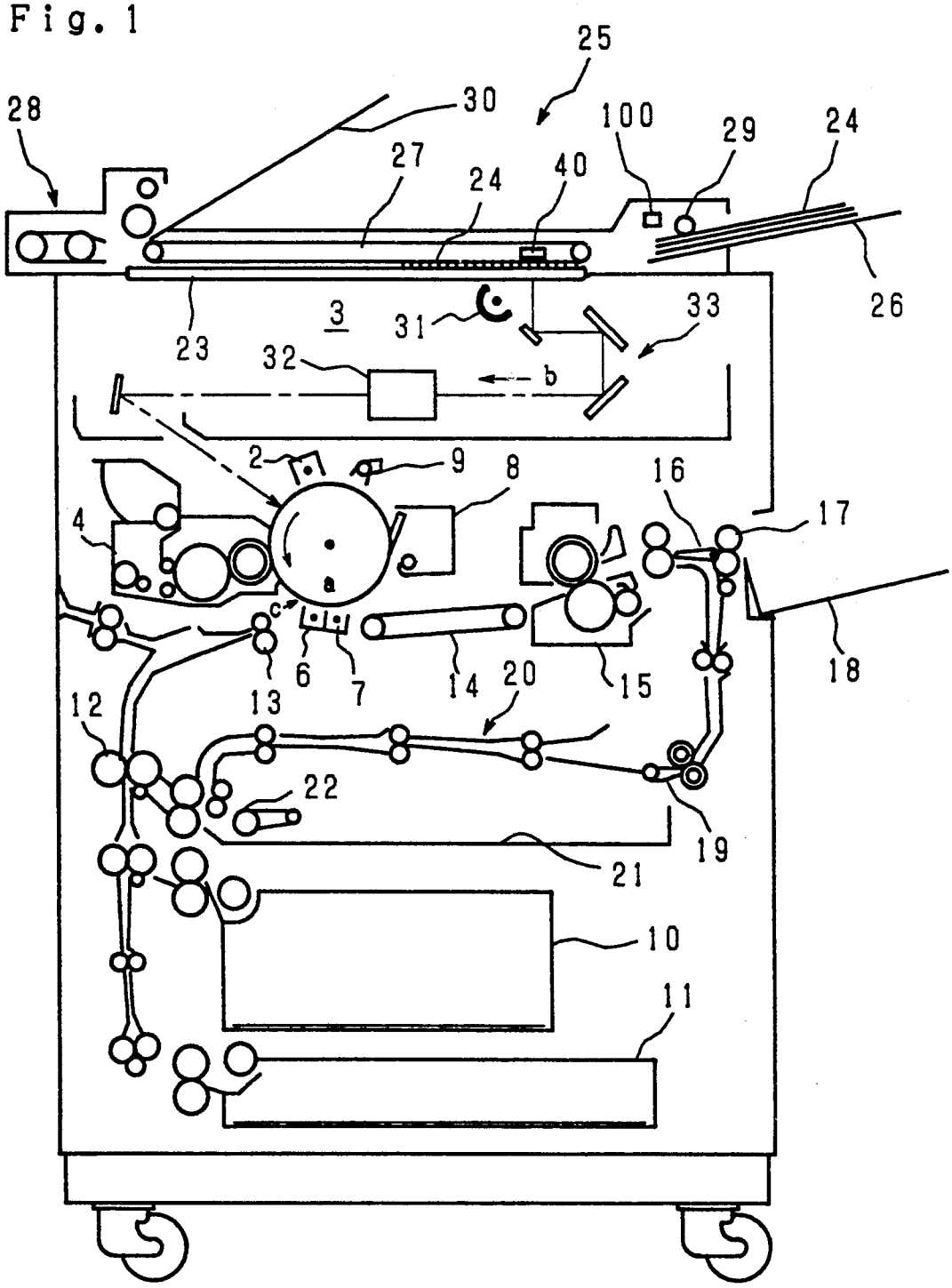
FIG. 1 is a longitudinally sectional view of a first embodiment of a copying machine of the invention, showing the internal structure thereof.

Referring to FIG. 1, reference numeral 1 designates a photosensitive drum having at the outer periphery thereof an organic charge generating layer and a charge transportation layer and rotatably driven in the direction of the arrow a. An electrostatic charger 2 is disposed above the photosensitive drum 1 and applies to the surface thereof the charge at a predetermined potential (Charge of negative polarity in these embodiments. Hereinafter, a value of charge is represented by the absolute value of magnitude and level.). An image exposure unit 3 is provided above the photosensitive drum 1 and electrostatic charger 2 and under a document table 23 of glass. The image exposure unit 3 comprises a mirror group 33 and an exposure lamp 31 scanning in the direction of the arrow b, and a lens 32, thereby forming on the surface of photosensitive drum 1 electrostatic latent images corresponding to the images at the lower face of a document 24 placed on the document table 23.

A developing unit 4 is provided at the downstream side of an electrostatic charger 2 in the rotation direction of the photosensitive drum 1. The developing unit 4 adopts a magnetic brush system to apply to the drum 1 bias voltage corresponding to the electrification potential applied by the electrostatic charger 2 so as to make visible the electrostatic latent images produced on the surface of photosensitive drum 1, thereby forming toner images. A transfer charger 6 is provided under the photosensitive drum 1 and applies the electric field to the lower side of a copying paper (not shown) transported in the direction of the arrow c, thereby transferring onto the copying paper the toner images formed on the photosensitive drum 1. A separation charger 7 is provided at the downstream side of the transfer charger 6 in the rotation direction of photosensitive drum 1 and applies an AC electric field to the copying paper just after transferred so as to deenergize the copying paper and peel it from the surface of photosensitive drum 1. A cleaning unit 8 is provided at the downstream side of the separation charger 7 in the rotation direction of photosensitive drum 1 and removes the residual toner on the surface of photosensitive drum 1 by the blade system. An eraser lamp 9 is provided between the cleaning unit 8 and the electrostatic charger 2. The eraser lamp 9 removes by the light irradiation the residual charge on the surface of photosensitive drum 1 in order to prepare for the next copy processing.

At the inner bottom of the body of the copying machine are disposed a first paper supply unit 10 and a second paper supply unit 11 for containing therein the copying papers corresponding to the number of contained papers or the size thereof. The copying paper selected by copy processing, when taken out from the paper supply unit 10 (or 11), is transported to timing rollers 13 through paper feed rollers 12 provided at the common transportation path and temporarily stopped. The copying paper is synchronized so that the toner images on the photosensitive drum 1 are transferred to the predetermined position on the copying paper, and sent between the photosensitive drum 1 and the transfer charger 6, after being transferred, the toner images and the copying paper is delivered to a fixing unit 15 through a conveyor belt 14. The fixing unit 15 melts and fixes by heat the toner images onto the copying paper. At the copying paper discharge side of the fixing unit 15 is provided a switch lever 16. The switch lever 16 is switched as to whether the copying paper on which the toner images are fixed is discharged via a discharge roller 17 to a paper discharge tray 18 or transported to a copying paper stock unit 21. When the double-sided copying or plural times copying on the same side is carried out, the copying paper having finished the one-sided copying or one-time copying is transported to the stock unit 21 provided above the first paper supply unit 10. The copying paper having finished the double-sided copying or predetermined times copying is adapted to be discharged onto the paper discharge tray 18.

At a transportation route from the switching pawl 16 to the stock unit 21 is provided a switch lever 19 for turning over the copying paper as to whether it is double-side copied or copied in an edit mode and for housing the copying paper in the stock unit 21. When double-side copied, the copying paper passes through a transportation route 20 provided above the stock unit 21 so as to contain therein the paper keeping upward the side of toner images, that is, the copied side. When copied plural times on the same side, the paper passes not through the route 20, but is contained keeping downward the copied side. The copying papers contained in the stock unit 21 are discharged by paper feed rollers 22 one by one to be transported to the paper feed rollers 12, images are again formed on the paper, and, when the double-sided copying or the predetermined times copying ends, the paper is discharged onto the paper discharge 18. In addition, a method detailed in U.S. Pat. No. 4,702,589 is usable for controlling the one-sided copy mode, double-sided copy mode and composite copy mode.

An auto document feeder (ADF) 25 is provided at the document table 23, which sends one by one a plurality of documents 24 placed on a document tray 26 to the predetermined position at the document table 23 through a document feed roller 29 and a document transportation belt 27. At the document discharge side of the document tray 26 is provided a document detection sensor 100 for detecting the document. Within the end of the belt 27 at the document feed side are provided light transmittance sensors 40 each using a light receiving element for measuring the light transmittance of document 24. A plurality of sensors 40 are disposed widthwise of the ADF 25, that is, perpendicularly to the transportation direction of the document and spaced at intervals of proper length. The belt 27 comprises a plurality of long strips and each sensor 40 faces the document through between the adjacent strips. In addition, when the belt 27 is of transparent material and the sensor 40 is measurable therethrough of the document, the belt 27 need not be formed in strip-like shape.

The usual document 24 conveyed by the belt 27 is discharged on a document discharge tray 30. The document, when double-sided copied, is sent into a document turn-over unit 28 and turned over therein and then again placed on the predetermined position at the document table 23 by the reverse rotation of belt 27. In addition, a method detailed in U.S. Pat. No. 4,702,589 is usable for controlling the transportation method for the document.

Figure 2:
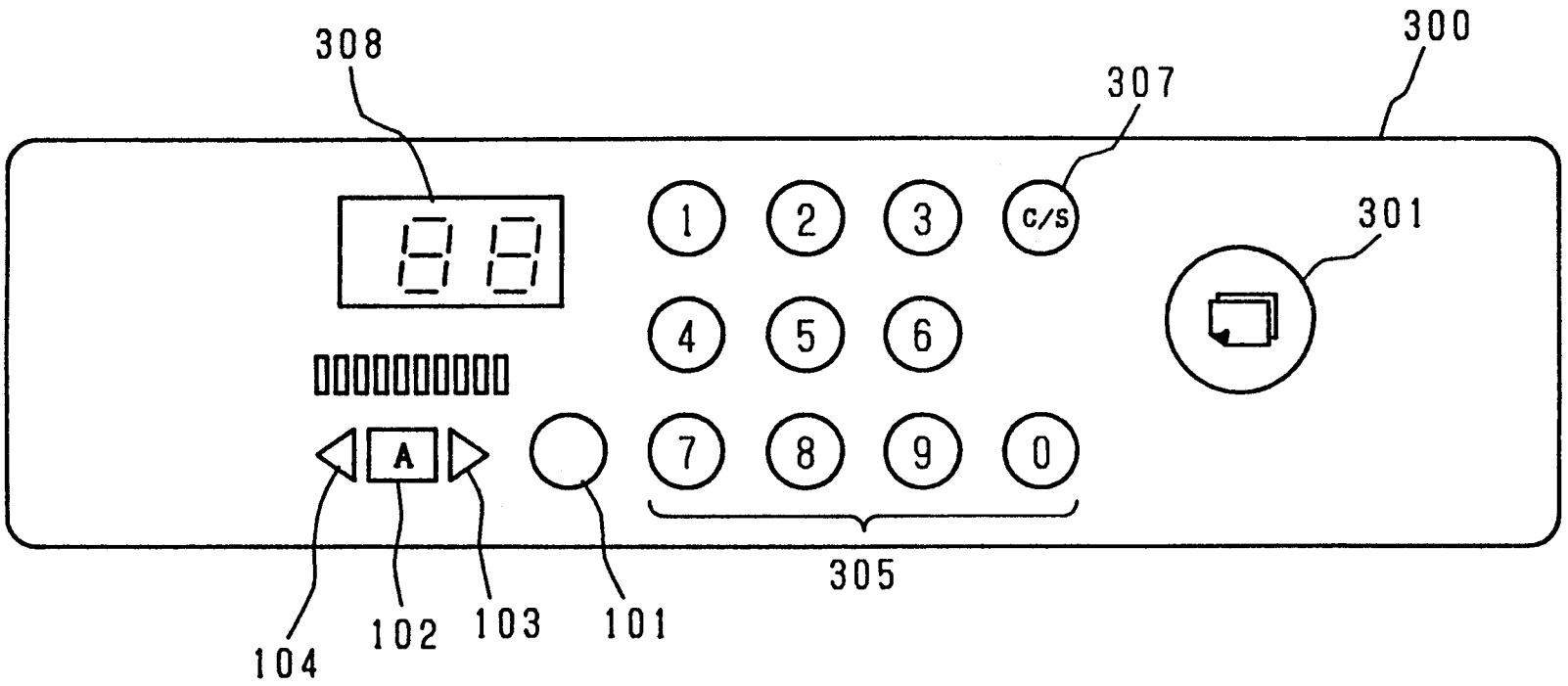
FIG. 2 is a typical view of an operation panel of the copying machine of the invention.

Referring to FIG. 2, an operation panel 300 provided at the copying machine of the invention is provided with a double-faced document mode setting key 101, an AE mode setting key 102, a copying concentration up key 103 and down key 104 for manually setting the copying concentration, a copy starting key 301, a ten-key 305, a clear/stop key 307, and a display 308 displaying the number of copied sheets. Alternatively, the key 101 may be provided at a console panel (not shown) at a side of ADF 25.

Figure 3:
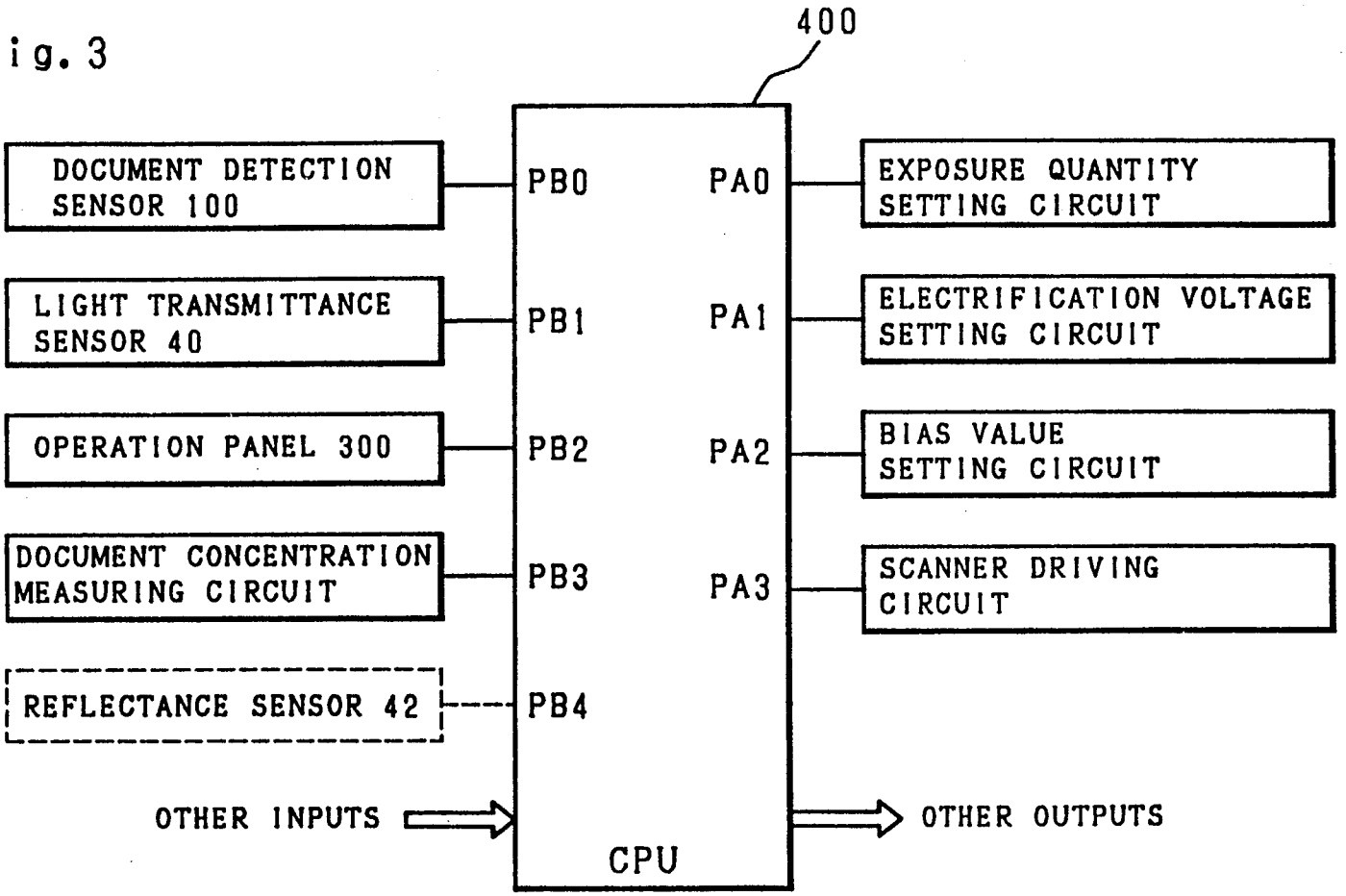
FIG. 3 is a block diagram thereof.

In the block diagram of the copying machine in FIG. 3, to the input side of CPU 400 are connected the document detection sensor 100, the light transmittance sensor 40, the operation panel 300, a document concentration measuring circuit, a reflectance sensor 42 (required only to third and foruth embodiments to be discussed below) and to the output side of the same are connected an exposure quantity setting circuit, an electrification voltage setting circuit, a bias value setting circuit, and a scanner driving circuit.

Next, explanation will be given on operation of the copying machine.

Figure 4:
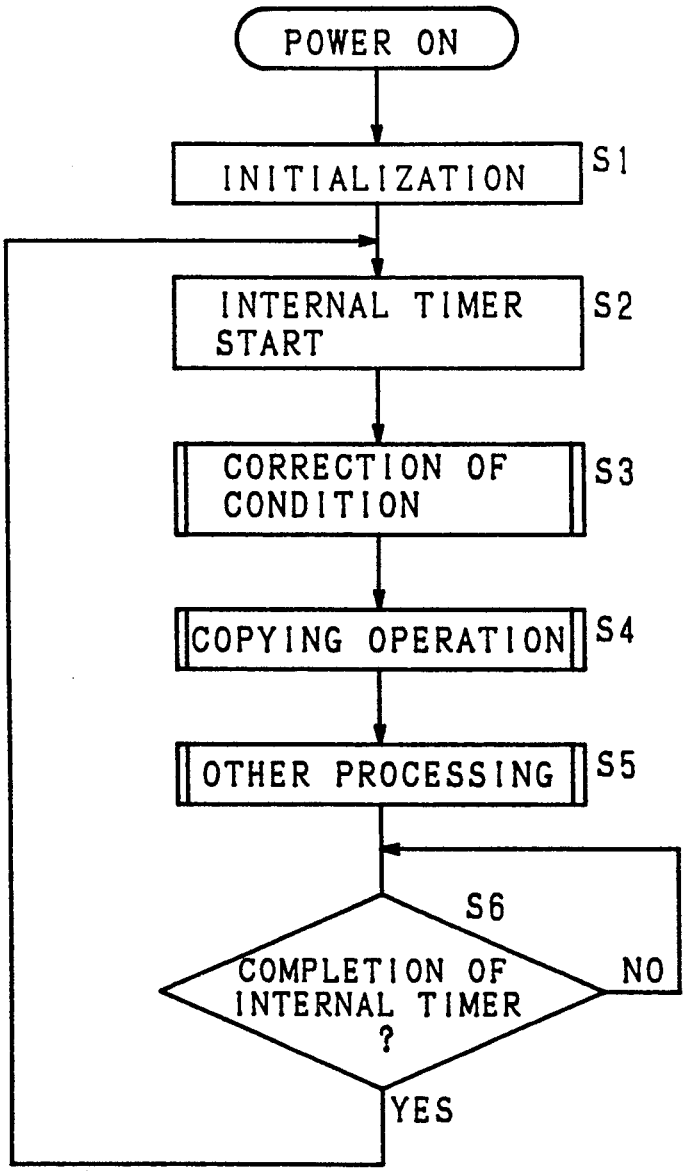
FIG. 4 is a flow chart showing a main routine of the same.
Figure 5:
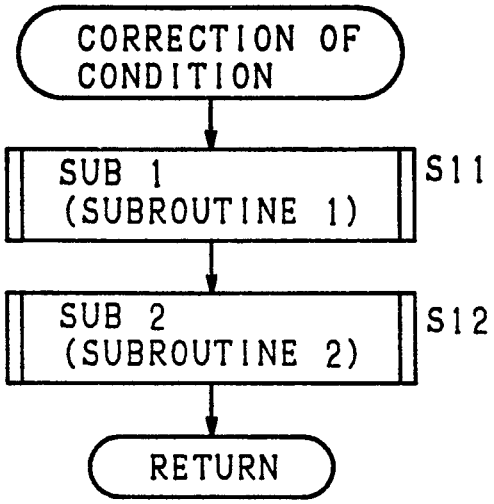
FIGS. 5, 6 and 7 are flow charts showing subroutines of operation of the first embodiment of the copying machine of the invention.
Figure 6:
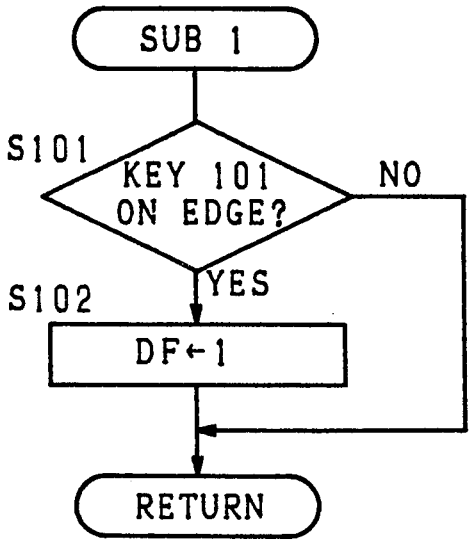
Figure 7:
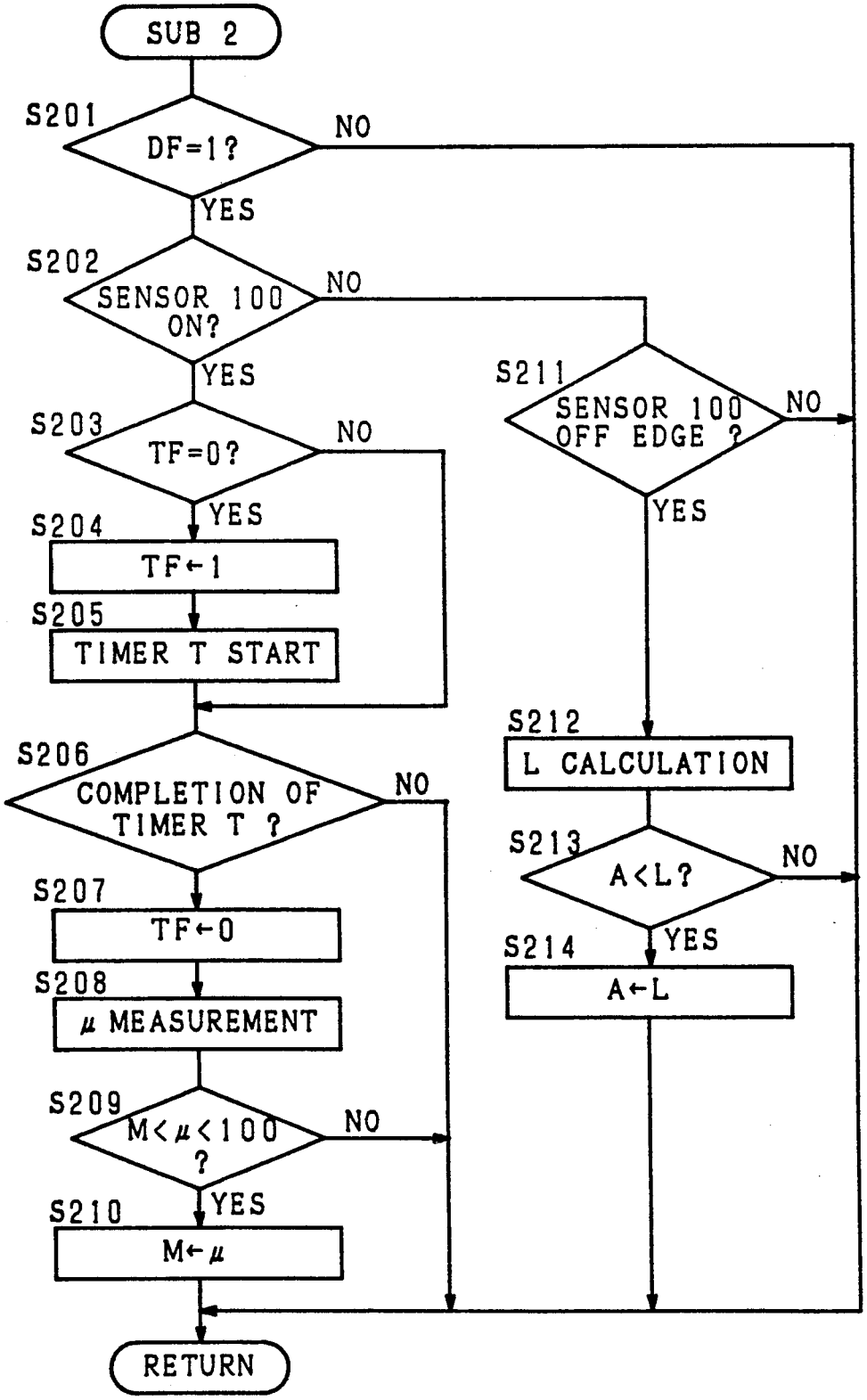
Figure 8A:
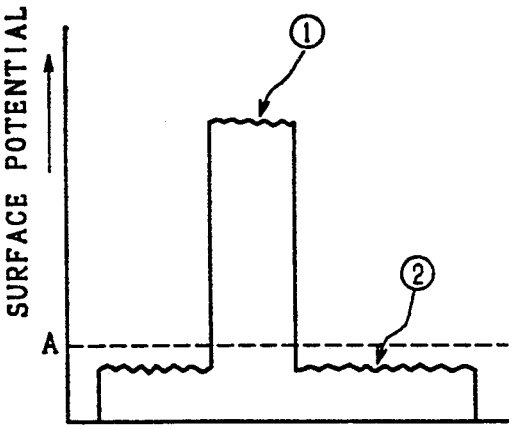
FIG. 8 shows surface potential distributions of a photosensitive drum after being exposed.
Figure 8B:
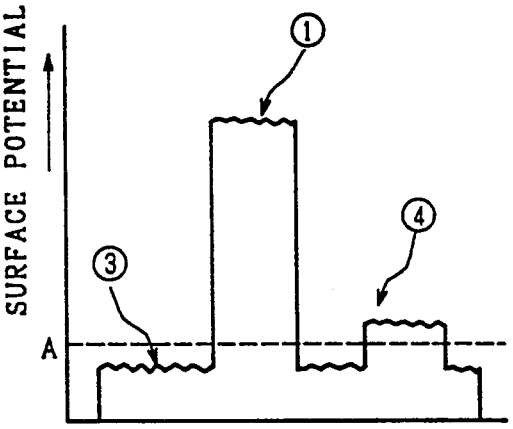
Figure 8C:
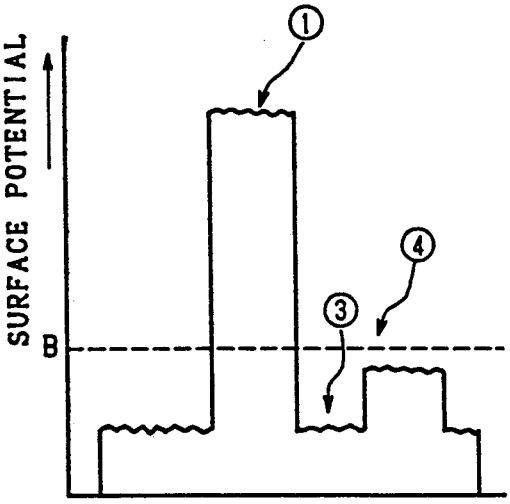
Figure 8D:
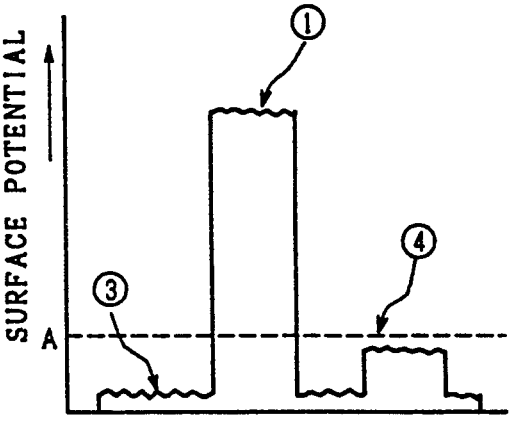

Referring to FIG. 4, S1 is initial setting, S2 is start of an inner timer, S3 is correction of image formation condition, S4 is copying operation, S5 is other processing including a communication routine with ADF 25, and S6 is measurement of time-up of the inner timer. FIG. 5 is a subroutine of S3 in FIG. 4, S3 including S11 (SUB 1) and S12 (SUB 2). FIGS. 6 and 7 are flow charts showing the subroutines SUB 1 and SUB 2.

Before the description of the flow chart, the terms "on-edge" and "off-edge" will be defined. When the states of a key and sensor change from the off state to the on state, this change of state will be defined as on-edge. When the states of the key and sensor change from the on state to the off state, the change of state is defined as off-edge.

When the key 101 is on-edge (S101:YES), a double-faced document mode flag DF is set (S102), so that ADF 25 under setting the flag DF is allowed to transport the double-faced document, the flag DF being reset after transportation of double-faced document by ADF 25 finishes.

After an operator sets the key 101, when the key 301 is depressed, an exposure lamp 31 is moved together with the mirror group 33 toward the right under the sensor 40 and then stopped. About simultaneously with feeding by the document feed roller 29 the document 24 placed on the document tray 26, the exposure lamp 31 is lit and the sensor 40 measures the light transmittance of document 24 while the document 24 is being transported toward the exposure position on the document table 23. Since a plurality of sensors 40 are disposed perpendicularly to the transporting direction of document 24, the light transmittance is measurable at the plural points in a spot-like manner for about the entire document 24. By increasing the measuring points as many as possible, the light transmittance at the portion where the image such as letters is not depicted, that is, a paper itself of document 24, is measurable as a maximum value among all the measuring points, where since the document may be punched when the light transmittance is nearly 100%, it is required that the copying machine is previously constructed to exclude such data.

Referring to FIG. 7, S201 through S210 show measuring operation for the maximum light transmittance of document 24. When the flag DF is 1 (S201:YES) and the sensor 100 is on (S202:YES), it is decided whether the flag TF is set (S203). The flag TF, when not set (S203:YES), is set (S204) and a timer T is started (S205), the timer T being used for measuring the light transmittance plural times per a predetermined time during the transportation of one document. When the timer T is time's up (S206:YES), the flag TF is reset (S207), and the maximum output of plural sensors 40 provided perpendicularly to the transportation direction of document is measured as the light transmittance $\mu$ (S208) and it is decided whether the measured light transmittance $\mu$ is larger than the content of a memory M and smaller than 100 (S209). An initial set value of memory M is zero and the former measured result is stored therein. When the measured value $\mu$ satisfies the above-mentioned quantitative relation (S209:YES), the value $\mu$ is written into the memory M.

As above-mentioned, the light transmittance of document 24 is measured by use of ADF 25, and even when the operator himself places the document 24 on the document receiving table 23 without operating ADF 25, the light transmittance is similarly measurable. In this case, although the measuring points are reduced because the document 24 is not moved, the sensor 40 is set of its measuring position in the vicinity of the end of the placed document 24, whereby even at the usual document the light transmittance at the non-image portion is measurable.

As the above-mentioned, upon measuring the light transmittance of document 24, the electrification voltage and developing bias voltage are adjusted in a predetermined proper value corresponding to the measured light transmittance, and the exposure quantity of the exposure lamp 31 is also adjusted corresponding to the same.

The calculation of image formation condition (electrification voltage, developing bias voltage and exposure quantity) is shown in S211 through S214 in FIG. 7. When the sensor 100 is off-edge (S211:YES), image formation condition L is calculated corresponding to the light transmittance stored in the memory M (S212), the condition L being decided to obtain the highest copying concentration in a range of generating no back image copying. The image formation condition A pregiven by another subroutine and this condition L are compared with each other (S213). When the condition L is larger than A (S213:YES), the back image copying is generated if left as it is, whereby the condition A is changed to that L (S214). In addition, the condition A is manually inputted by the keys 103 and 104 operated by the operator, or automatically set at the AE mode.

Thus, since the copying operation is carried out after the image formation condition is set corresponding to the measured light transmittance, clear copy images free from back image copying are obtainable.

The relation between the electrification voltage of the photosensitive drum 1 and the bias voltage for the developing unit 4 will be described according to the distribution graphs of the surface potential of the photosensitive drum after exposed as shown in FIG. 8. FIG. 8(*a*) shows a distribution graph for the single-faced document. The image portion ① remains as its surface potential is high and the non-image part, that is, the lower portion ②, lowers at potential under the developing bias value A by the exposure light as shown by the broken line. When developed at the aforesaid potential, toner is attached only to the image portion ① having potential higher than the developing bias so as to be made positive, thereby obtaining good copied images.

Figure 9A:
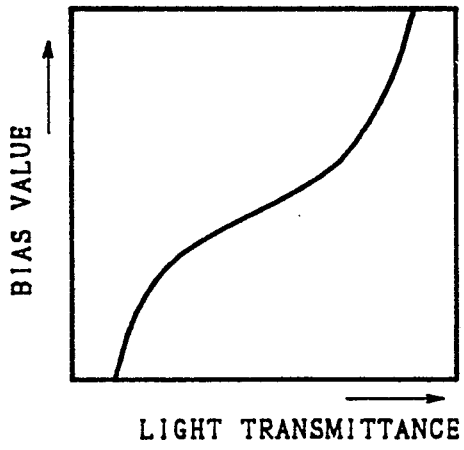
FIG. 9 shows correlations between a developing bias value and a light transmittance.
Figure 9B:
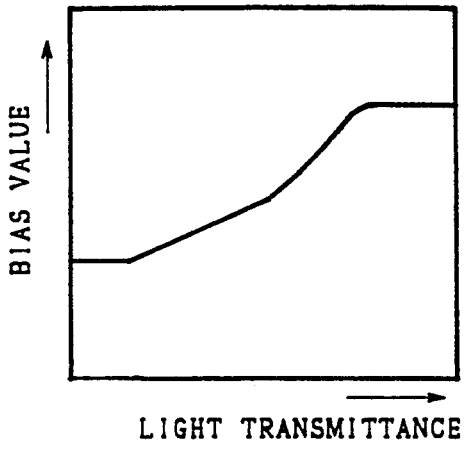

FIG. 8(*b*) is a distribution graph for the double-faced document, in which the image portion is designated by ① and the blank portions by ③ and ④. When the document is smaller in thickness, in other words, higher in the light transmittance and no image is found on the back of blank portion, the potential is under a developing bias value A as shown by ③, but when the image is on the back, the quantity of reflected light lowers, so that the potential is higher than the developing bias value A as shown by ④. As a result, when developed, the blank portion ④ also is attached with toner to cause the back image copying. FIG. 9(*a*) shows a relation between a minimum value of developing bias value and the light transmittance of document not to cause the back image copying, where the minimum value of developing bias value is usually set of a lower limit value and an upper limit value. The lower limit value is decided in order that the blank of document is not affected. There is the problem regarding prevention of carrier sticking and developing gap (a difference between the initial surface potential of photosensitive drum and the developing bias value), in other words, when the developing bias is too high, electrification voltage is raised to exceed the breakdown voltage ability of the photosensitive drum as discussed below or the electrostatic charger is loaded, whereby the upper limit value of developing bias value is set. Therefore, it is preferable to correct the relation between the minimum value of developing bias value and the light transmittance of document as shown in FIG. 9(*b*).

In the copying machine of the invention, a developing bias value B (>A) is selected on the basis of the above relation and electrification voltage is previously increased not to reduce the developing gap, in which the distribution of surface potential of photosensitive drum is shown in FIG. 8(*c*). As seen from FIG. 8(*c*), the developing bias value B is higher than the potential of the blank ④ of document having images on the rear face, thereby not creating the back image copying. The surface potential at the image portion ① is high because the electrification voltage is raised, so that the development gap between the surface potential and the developing bias value B is not reduced. Accordingly, the image concentration of image portion ① does not lower and a constant image concentration equivalent to the single-faced document can be ensured so as to obtain clearly copied images.

Figure 10A:
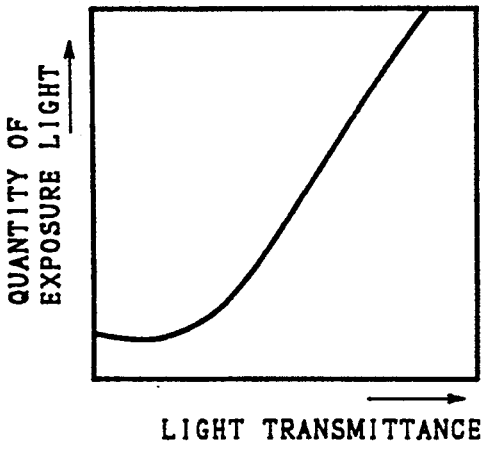
FIG. 10 shows the correlation between a quantity of exposure light and the light transmittance.
Figure 10B:
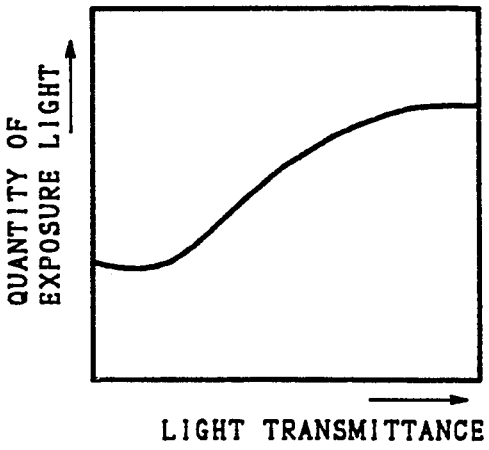

FIG. 10(*a*) shows the relation between the minimum value of quantity of exposure light and the light transmittance of document in order not to create the back image copying. It is preferable, for the minimum value of quantity of exposure light to set the upper and lower limit values similarly to the developing bias value and to correct the same as shown in FIG. 10(*b*). The upper limit value is set in order to improve capacity of the exposure lamp 31 and reproductivity of half tone. The lower limit value is set in order that the blank is not affected. In the copying machine of the invention, such the relation is used to select the quantity of exposure light corresponding to the light transmittance of document, thereby increasing the quantity of light more than usual. In this case, the distribution of surface potential of photosensitive drum is shown in FIG. 8(*d*). Upon increasing the quantity of exposure light, the quantity of reflected light at the blank ④ is increased, thereby enabling the potential to be restricted under the developing bias value A. In addition, the potential lowering at the image portion ① following an increase in quantity of exposure light is negligible at most photosensitive drums except for an As-Se photosensitive drum of high sensitivity, whereby no correction of increasing electrification voltage may often be required.

Next, a modified embodiment of the copying machine of the invention will be concretely described mainly of a measuring mechanism for the light transmittance of document.

Figure 11:
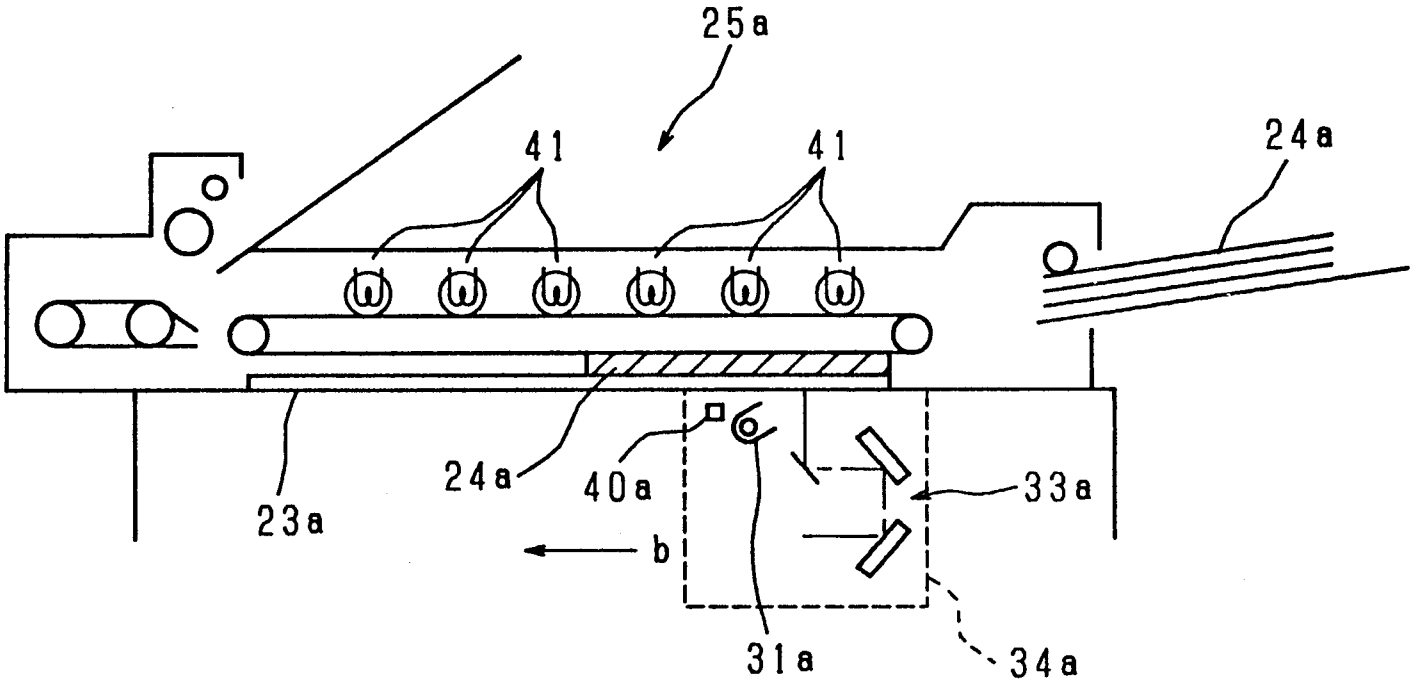
FIG. 11 is a longitudinally sectional view of the principal portion of a second embodiment of the copying machine of the invention.

Referring to FIG. 11 showing a second embodiment of the invention, an ADF 25*a* (or a document cover) is provided with a plurality of lamps 41 disposed opposite to the document table 23*a* and in the transportation direction of document 24*a* and in the direction perpendicular thereto, the lamps 41 illuminating approximately the entire document 24*a* placed on the document table 23*a* from the upper face, that is, the rear face. A scanning optical system 34*a* having an exposure lamp 31*a* and mirror group 33*a* and scanning in the direction of the arrow b is provided with a sensor 40*a* similar to the sensor 40 shown in FIG. 1 and opposite at the light receiving part to the document table 23*a*. The sensor 40*a* moves in the direction of the arrow b, that is, in the transportation direction of document, following the movement of scanning optical system 34*a*. In addition, the lamps 41 need only be constructed to uniformly illuminate the document 24*a* entirely, in other words, the document receiving plate 23*a* entirely, for example, a plurality of tubular lamps may be provided. Other constructions are the same as the first embodiment.

The light transmittance at the second embodiment using ADF 25*a* is carried out as follows: The sensor 40*a* is positioned. under the end of document table 23*a* at a side of transporting the document 24*a* and the lamps 41 only opposite to the sensor 40 are lit so that the light transmittance may be measured while the document 24*a* is transported. Also, after the document 24*a* is transported toward the predetermined position, the scanning optical system 34*a* may be moved to measure the light transmittance. Even when an operator places by hand the document on the document receiving plate 23*a* without using the ADF 25*a*, the lamps 41 are lit and the scanning optical system 34*a* is moved, whereby the sensor 40*a* can measure the light transmittance about throughout the document, in which the measuring points are not insufficient and the light transmittance at the blank is reliably measureable.

The flow chart of operation of the second embodiment comprises FIGS. 4, 5, and 6 flow charts the same as the first embodiment and that in FIG. 7 in which S202 is changed to "in scanning?" and S211 to "scanning end?".

Figure 12:
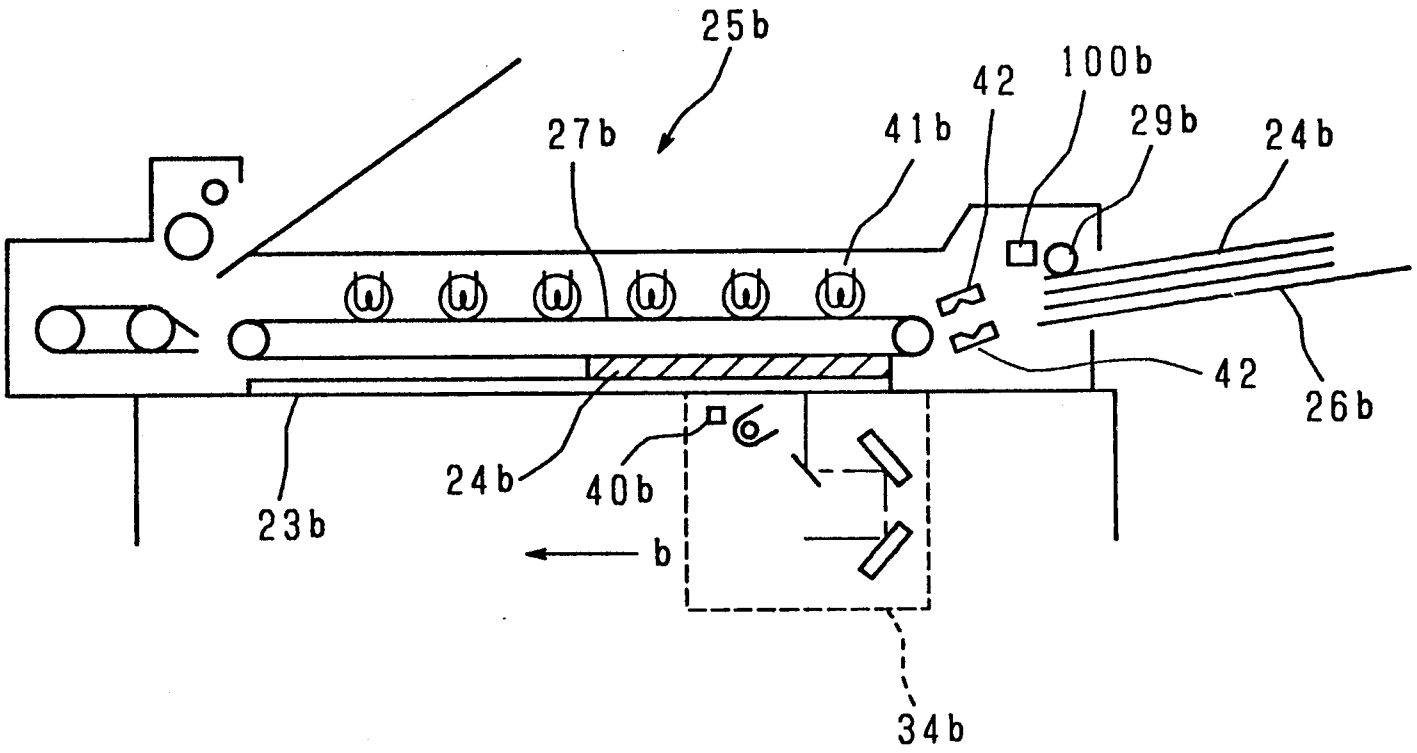
FIG. 12 is a longitudinally sectional view of the principal portion of a third embodiment thereof.

FIG. 12 is the longitudinal sectional view of the principal portion of a third embodiment, which is so constructed that the second embodiment is added with function to automatically discriminate whether a document is double-faced or single-faced. In the first and second embodiments, a double-faced document is discriminated by operator's manual operation, but in the third embodiment, a double-faced document can automatically be discriminated, so that the back image copying caused by forgetting manual operation can be prevented.

Figure 13:
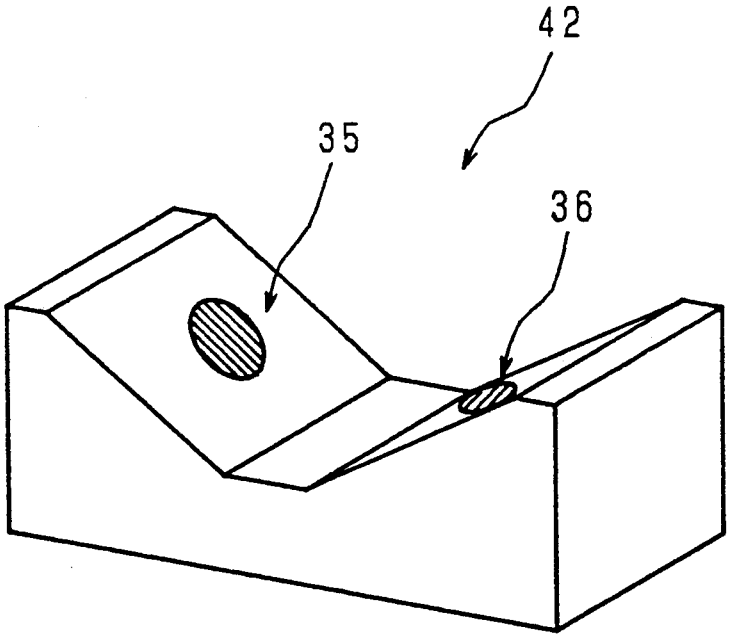
FIG. 13 is a perspective external view of a sensor for detecting a surface reflectance of document.

Reflectance sensors 42 are disposed opposite to each other above and under a document transporting route between the document tray 26*b* and the document table 23*b*. The sensors 42 are, for example, every three provided in the widthwise direction of the ADF 25*b*, and the center sensor is disposed opposite to the central portion of the document transporting route and both-side ones spaced from the center one at about 50 mm interval widthwise of the same. Each sensor 42, as shown in FIG. 13, has a V-like-shaped slope, on which a light emitting element 35 and a light receiving element 36 are provided. The light from the light emitting element 35 is irradiated to the document 24*b* and the reflected light therefrom is received by the light receiving element 36, thereby detecting the surface reflectance of document 24*b*. Three sensors 40*b* for measuring the light transmittance are mounted on a scanning optical system 34*b* and positioned corresponding to the sensors 40 respectively.

When the operator sets the document 24*b* on the document tray 26*b* and depresses the copy starting key 301, the sensors 40*b* are positioned opposite in the vicinity of the end of document table 23*b*. A document feed roller 29*b* starts transport of document 24*b*, and when a sensor 100*b* detects transport of document 24*b*, the sensors 42 measure the surface reflectances on both faces of document 24*b* under transportation. The lamps 41*b* opposite to the sensors 40*b* are lit, the sensors 40*b* measuring the light transmittance of document 24*b*. In this case, when the reflectance detected by the upper sensor 42 is constant and fairly higher than a predetermined value, the transported document is single-faced, thereby being subjected to usual copying. Since the sensors 42 and 40*b* are apart in the measuring position from each other, it is possible to measure the light transmittance by the sensor 40*b* of only the portion detected of the maximum reflectance by both the upper and lower sensors 42. Thus, the blank at the document 24*b* is effectively measurable of the light transmittance.

Figure 14:
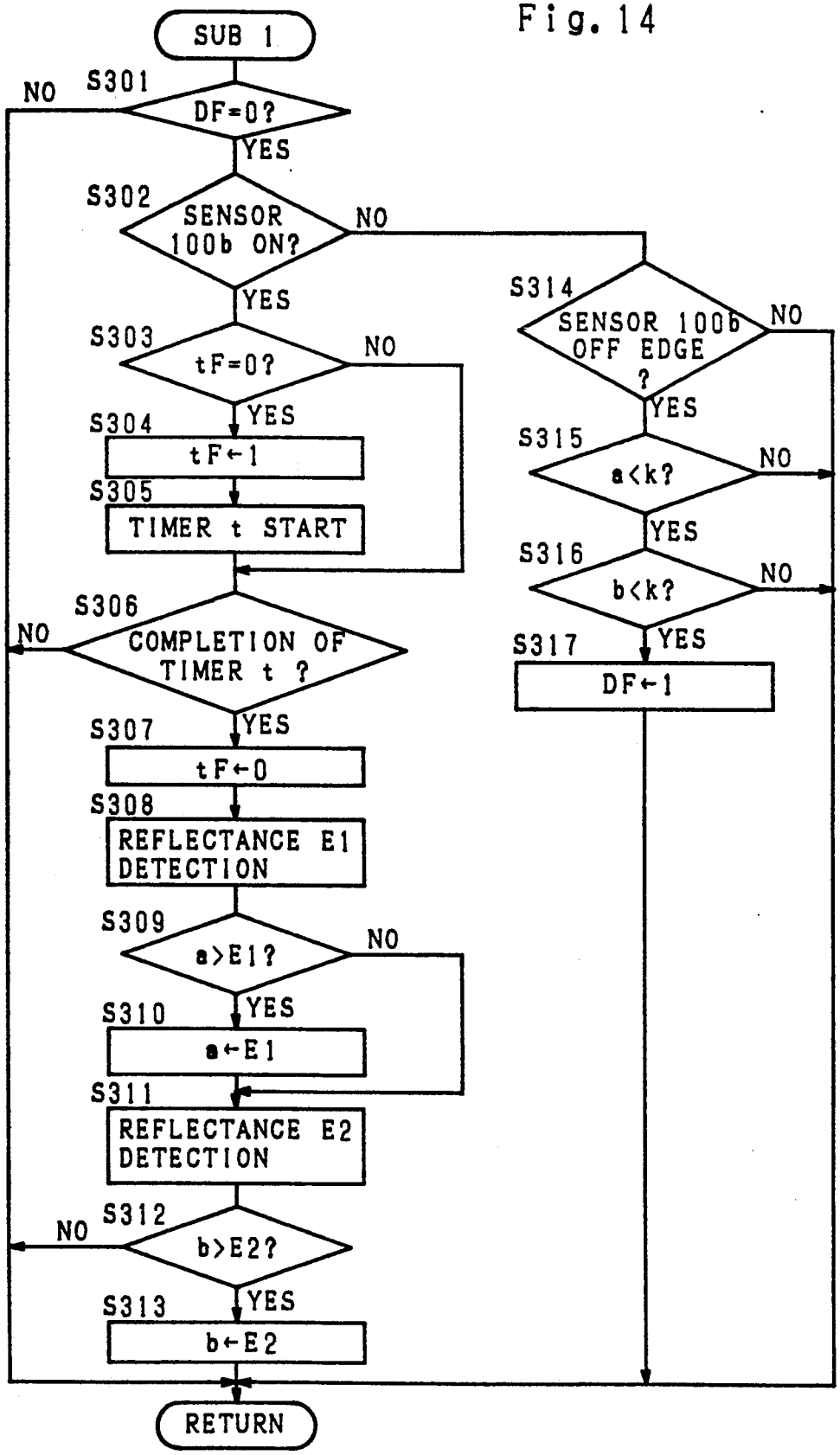
FIG. 14 is a flow chart of the subroutine of operation at the third embodiment.

The flow chart of main routine at the third embodiment is the same as that in FIG. 4 and the flow chart in S3 is the same as that in FIG. 5. The flow chart of SUB 1 constituting S3 is as shown in FIG. 14 and the flow chart of SUB 2 is the same as the second embodiment, in other words, in FIG. 7, S202 is changed of its content to "in scanning?" and S211 to "scanning end?".

When the double-faced mode is not set (S301:YES) and the sensor 100*b* is on (S302:YES), it is decided whether or not a flag tF is set (S303). The flag tF, when not set (S303:YES), is set (S304) to start a timer t (S305), the timet t being used for detecting the reflectance at one document plural times every predetermined time during the transportation. When the timer t is time's up (S306:YES), the flag tF is reset (S307) to detect the smallest reflectance E1 at the upper face of document (S308). The detected reflectance E1 is decided as to whether it is smaller than the content of memory a (S309), when smaller (S309:YES), the reflectance E1 is written into the memory a (S310). Also, the smallest reflectance E2 at the lower face of document is detected (S311), it is decided whether the detected reflectance E2 is smaller than the content of memory b (S312), when smaller (S312:YES), the reflectance E2 is written into the memory b (S313). The initial set values of the memories a and b are each 100. When the off-edge of sensor 100*b* decides finish of document transportation (S314:YES) and the value of memory a is smaller than the predetermined value k (S315:YES) and moreover the value of memory b is smaller than the predetermined value k (S316:YES), the flag DF is set (S317).

Thus, it is decided, corresponding to the reflectances at the upper and lower faces of document, whether the document is double-faced or single-faced.

In the third embodiment, the sensor 40*b* measures the light transmittance of document. Besides this, an exclusive light transmittance sensor and a light source when ADF 25*b* is used may be mounted between the upper sensors 42 and between the lower sensors 42. Hence, the surface reflectance and light transmittance will simultaneously be obtained. The light transmittance, when no ADF 25*b* is used, is measured similarly to the second embodiment by use of the sensors 40*b* and lamps 41*b*. In addition, the sensors 42 may also be used as a document concentration measuring sensor for automatic exposure.

Figure 15:
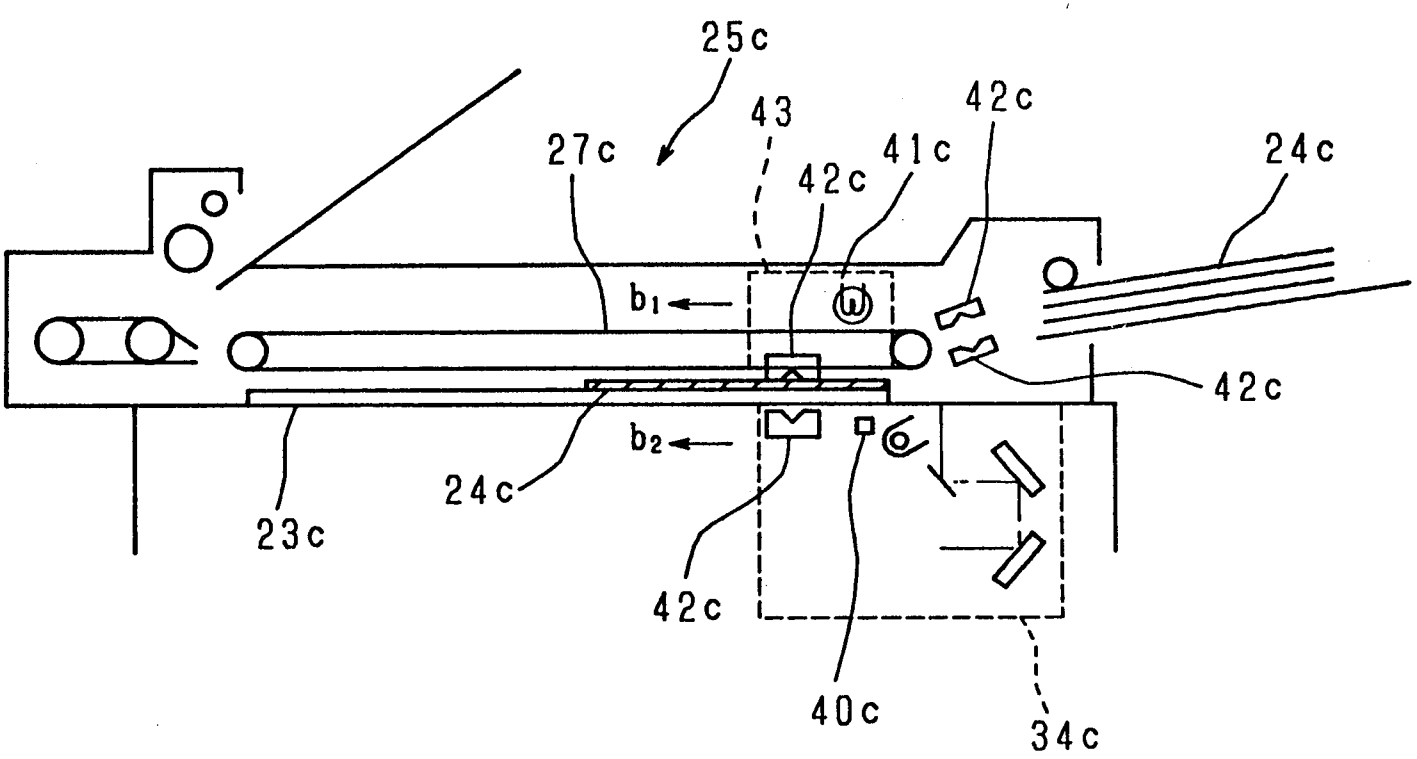
FIG. 15 is a longitudinally sectional view of the principal portion of a fourth embodiment of the copying machine of the invention, and FIGS. 16 (*a*) and (*b*) are flow charts of the subroutine of operation at the fourth embodiment.

FIG. 15 shows the principal portion of a fourth embodiment of the copying machine of the invention, which can discriminate a double-faced document between a single-faced document even when the operator places a document 24*c* on a document table 23*c* without using ADF. A detecting unit 43 integrally provided with a lamp 41*c* for measuring the light transmittance and sensors 42*c* for detecting surface reflectance of the rear face, that is, the upper face of document, is provided in the ADF 25*c* (or a document cover). A detecting unit 43 scans the document 24*c* in the direction of the arrow $b_1$. A belt 27*c* comprises a plurality of strip-like-shaped belts and a plurality of sensors 42*c* are disposed between the belts so as to allow the sensors 42*c* to approach the document 24*c* as close as possible. The lamp 41*c* need only have an illumination range corresponding to a widthwise length of document table 23*c*. A scanning optical system 34*c* for scanning in the direction of the arrow $b_2$ is provided with a sensor 40*c* for measuring the light transmittance and a sensor 42*c* for detecting the surface reflectance of the front face, that is, the copied face of document. The detecting unit 43 and scanning optical system 34*c* scan the document 24*c* in the same directions while being synchronized in a manner that the sensors 40*c* and 42*c* are opposite to each other just under the lamp 41*c* and sensor 42*c* through the document table 23*c* and document 24*c*. The document 24*c* placed by the operator directly to the document table 23*c* is measured of surface reflectances of both faces and light transmittance, so that it is discriminated by the surface reflectance whether or not the document 24*c* is double-faced document.

Figure 16A:
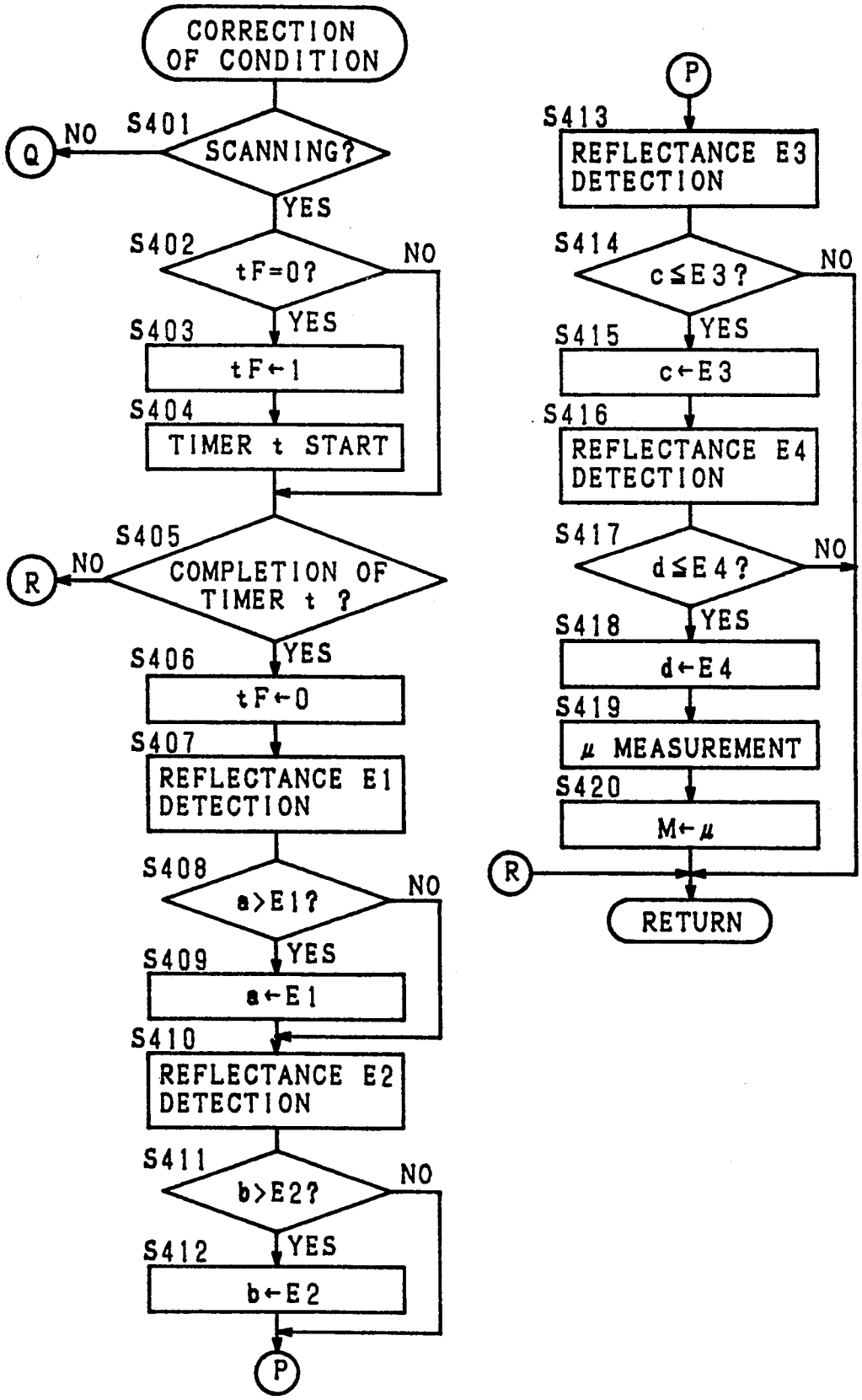
Figure 16B:
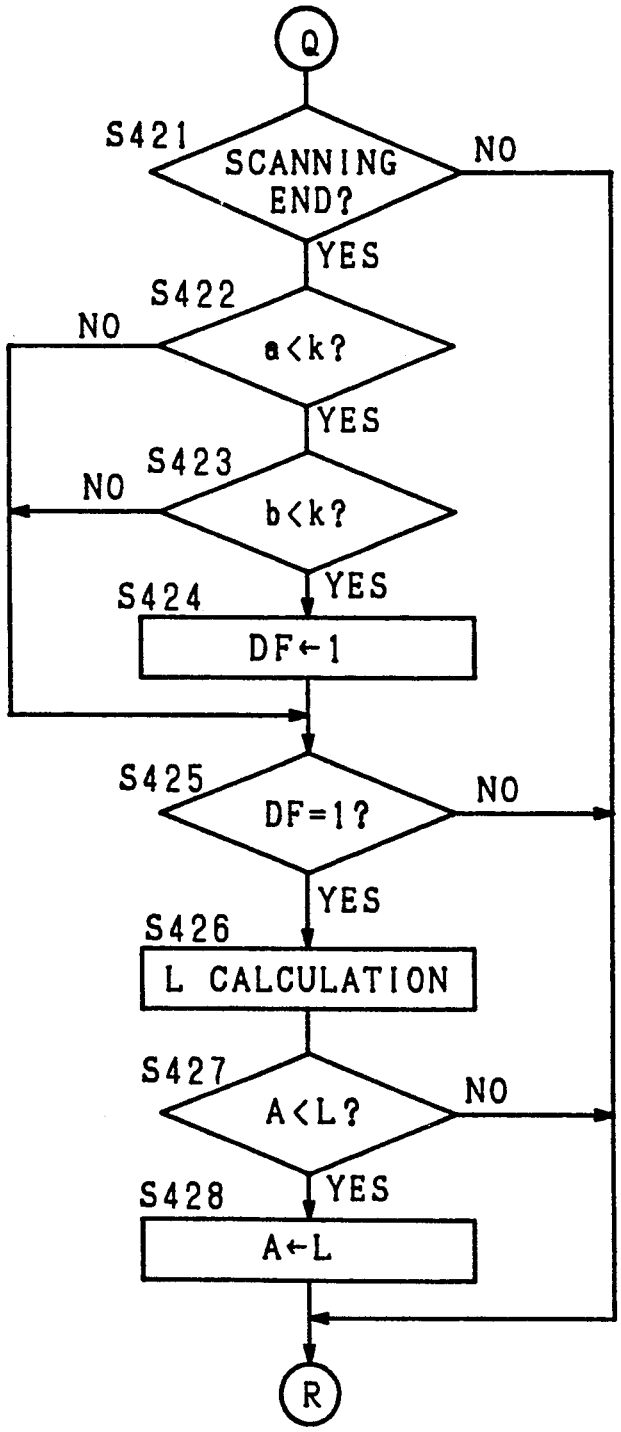

The flow chart of main routine at the fourth embodiment is the same as that in FIG. 4, the flow chart in S3 being as shown in FIG. 16.

When it is decided that the unit is in scanning (S401:YES), a flag tF is decided as to whether it is set (S402). The flag tF, when not set (S402:YES), is set (S403) and a timer t is started (S404), the timer t being used for detecting the reflectance at one document plural times every predetermined time during the transportation. When the timer t is time's up (S405:YES), the flag tF is reset (S406) to detect the smallest reflectance E1 at the upper face of document (S407). It is decided whether the detected reflectance E1 is smaller than the content of memory a (S408), when smaller (S408:YES) the reflectance E1 is written into the memory a (S409). Also, the smallest reflectance E2 at the lower face of document is detected (S410) and the detected reflectance E2 is decided as to whether it is smaller than the content of memory b (S411), when smaller (S411:YES), the reflectance E2 is written into the memory b (S412). The initial set values of memories a and b are each 100. The largest reflectance E3 at the upper face of document is detected (S413). The detected reflectance E3 is decided as to whether it is not less than the content of memory c (S414). When not less (S414:YES), the reflectance E3 is written into the memory c (S415). Also, the largest reflectance E4 at the lower face of document is detected (S416) and the detected reflectance E4 is decided as to whether it is not less than the content of memory d (S417), when not less (S417:YES), the reflectance E4 is written into the memory d (S418). The initial set values of memories c and d are each zero. The largest light transmittance $\mu$ in the document is measured (S419) and the measured light transmittance $\mu$ is stored in a memory M (S420). The light transmittance $\mu$ corresponding to the highest one of the outputs of the plurality of sensors 40*c* provided in the direction perpendicular to the transportation direction of document.

The scanning end is decided (S421:YES) and when the value of memory a is smaller than a predetermined value k (S422:YES) and the value of memory b is smaller than the predetermined value k (S423:YES), a double-faced document mode flag DF is set (S424). When the double-faced document mode is set (S425:YES), image formation condition L (electrification voltage, developing bias value and quantity of exposure light) is calculated on the basis of the light transmittance stored in the memory M and decided (S426). The condition L is decided so as to obtain the highest copying concentration in a range of generating no back image copying. The image formation condition A previously given by another subroutine is compared with the condition L (S427:YES), the back image copying is generated if left as it is, thereby changing the condition A to that L (S428).

In the aforesaid embodiments, the light transmittance of the document is measured and the image formation condition is changed corresponding to the measured light transmittance, but the changeable image formation condition need only change the copying concentration, thereby being not limited to the electrification voltage, developing bias value and quantity of exposure light.

In the aforesaid embodiments, the copying concentration regarding the double-faced document mode is corrected, but even for the single-faced document mode it is desirable to measure the light transmittance of the document and to correct the copying concentration corresponding to the measured light transmittance in order to prevent the document from being affected by the spots of the document transportation belt of ADF or the document cover. Accordingly, correction of copying concentration of the invention can be utilized in the single-faced document mode as well as the double-faced document mode.

Furthermore, when the copying concentration is manually inputted by the up key 103 or down key 104 on the operation panel 300, other than that the copying concentration is automatically corrected corresponding to the light transmittance of document, the predetermined message may be displayed in the display unit (not shown) so as to urge the operator to change the copying concentration. For example, when the measured light transmittance is high so as to have a high possibility of generating the back image copying, the display unit need only indicate "lower copying concentration".

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A copying machine irradiating light to a document from an exposure light source, guiding the reflected light from said document to a photosensitive body so as to form latent images corresponding to images of said document, supplying toner from a developing unit so as to develop said latent images, and transferring said developed images onto a copying paper, comprising:

measuring means for measuring light transmittance of said document, said measuring means using said exposure light source as its light source when the light transmittance of said document is measured; and adjusting means for adjusting a copying condition corresponding to said light transmittance measured by said measuring means.

2. A copying machine according to claim 1, wherein said adjusting means adjusts quantity of light from said exposure light source.

3. A copying machine according to claim 1, wherein said adjusting means adjusts the electrification voltage of said photosensitive body.

4. A copying machine according to claim 1, wherein said adjusting means adjusts the developing bias voltage.

5. A copying machine according to claim 1, further comprising discriminating means for discriminating whether said document is a double-faced document or a single-faced document.

6. A copying machine according to claim 5, wherein said measuring means measures the light transmittance of said document, when said discriminating means discriminates said document is double-faced.

7. A copying machine according to claim 5, wherein said discriminating means discriminates whether said document is double-faced or single-faced corresponding to light reflectance at both faces of said document.

8. A copying machine according to claim 1, further comprising feeding means for automatically feeding said document toward an exposure position.

9. A copying machine according to claim 8, wherein said measuring means starts operation in accordance with start of operation of said feeding means.

10. A copying machine according to claim 8, further comprising discriminating means for discriminating whether said document is double-faced or single-faced.

11. A copying machine according to claim 1, wherein said exposure light source scans said document.

12. A copying machine according to claim 11, wherein said measuring means scans said document together with said exposure light source.

13. A copying machine according to claim 12, wherein said measuring means uses said means for illuminating as a light source when the light transmittance of said document is measured.

14. A copying machine for copying images of a document onto a copying paper with variable copying concentration, comprising:

a photosensitive body;

means for illuminating said document;

means for projecting the reflected light from said document onto said photosensitive body to thereby form electrostatic latent images;

means for changing said electrostatic latent images on said photosensitive body to visible images;

means for transferring onto said copying paper said visible images on said photosensitive body;

detecting means for detecting whether or not images exist at both faces of said document;

measuring means for measuring light transmittance of said document; and means for deciding an optimum copying concentration on the basis of the measured light transmittance only when said detecting means detects that images exist at the both faces of said document.

15. A copying machine according to claim 14, said detecting means including means for measuring light reflectance of both faces of an original.

16. A copying machine irradiating light to a document from an exposure light source, guiding the reflected light from said document to a photosensitive body so as to form latent images corresponding to images of said document, supplying toner from a developing unit so as to develop said latent images, and transferring said developed images onto a copying paper, comprising:

means for inputting copying concentration;

measuring means for measuring light transmittance of said document, said measuring means using said exposure light source as its light source when the light transmittance of said document is measured;

means for deciding an optimum copying concentration on the basis of the measured light transmittance, and means for controlling the copying operation with either of the inputted copying concentration and the decided optimum copying concentration.

17. A copying machine for copying images of a document onto a copying paper with variable copying concentration, comprising:

a photosensitive body;

feeding means for automatically feeding said document toward an exposure position;

means for illuminating said document at said exposure position;

means for projecting the reflected light from said document onto said photosensitive body to thereby form electrostatic latent images;

means for changing said electrostatic latent images on said photosensitive body to visible images;

means for transferring onto said copying paper said visible images on said photosensitive body;

detecting means for detecting whether or not images exist at both faces of said document;

means responsive to said detecting means for controlling said feeding means;

measuring means for measuring light transmittance of said document; and means for deciding an optimum copying concentration on the basis of the measured light transmittance only when said detecting means detects that images exist at both faces of said document.

18. A copying machine according to claim 15, said detecting means including means for measuring light reflectance of both faces of an original.

19. A method of obtaining light transmittance of a document, comprising:

a first step of measuring light reflectance of one face of the document;

a second step of measuring light reflectance of the other face of the document;

a third step of measuring light transmittance of the document when the measured light reflectance of one face of the document is larger than a first predetermined value and the measured light reflectance of the other face of the document is larger than a second predetermined value, and a fourth step of storing the measured light transmittance of the document into a memory.

* * * * *